US005221193A

United States Patent [19]

Stougaard

[11] Patent Number: 5,221,193

[45] Date of Patent: Jun. 22, 1993

[54] HIGH-PRESSURE CLEANER WITH ENCAPSULATED MOTOR-PUMP ASSEMBLY

[75] Inventor: Henning Stougaard, Hadsund, Denmark

[73] Assignee: K.E.W. Industri A/S, Denmark

[21] Appl. No.: 866,015

[22] Filed: Apr. 8, 1992

[30] Foreign Application Priority Data

Mar. 17, 1992 [DK] Denmark ..... 0354/92

[51] Int. Cl.[5] ..... F04B 17/00; F04B 35/04

[52] U.S. Cl. ..... 417/415; 417/410 R

[58] Field of Search ..... 417/415, 410; 310/89, 310/112; 137/855

[56] References Cited

U.S. PATENT DOCUMENTS 4,627,798 12/1986 Thomas ..... 417/415
4,834,626 5/1989 Prevosto ..... 417/415
4,946,451 8/1990 Cianci ..... 137/855
5,053,633 10/1991 Sugiyama et al. ..... 310/89
5,111,681 5/1992 Yasui et al. ..... 417/415

*Primary Examiner*—Richard A. Bertsch
*Assistant Examiner*—Alfred Basichas
*Attorney, Agent, or Firm*—Larson and Taylor

[57] ABSTRACT

In a high-pressure cleaner, in which the motor and possibly at least parts of the pump are enclosed in a watertight housing (8), an outwardly opening non-return valve is provided in the wall of the housing. The valve is preferably formed by a number of holes (17) in the wall of the housing, these holes being covered by a taut rubber strap (18). With this arrangement, excess pressures caused by combustible substances in the housing being ignited, such as by commuter sparks or a hot part of the motor, are released, thus avoiding damage to the housing.

8 Claims, 2 Drawing Sheets

HIGH-PRESSURE CLEANER WITH ENCAPSULATED MOTOR-PUMP ASSEMBLY

BACKGROUND ART

High-pressure cleaners of the kind referred to above are known, e.g. from European patent application No. 420,473. Experience has shown that in certain cases and under certain operating conditions, combustible or gas mixtures may form in the space within the housing not occupied by the electric drive motor and possibly at least part of the pump or the latter's drive mechanism. Thus, cases of violent combustion have occurred, causing damage to or deformation of the parts surrounding the space occupied by the combustible gas mixture. It appears that in some cases, the phenomena are caused by oil having seeped through worn seals from the pump, or by chemicals or solvents in the electric drive motor being driven out when the motor becomes hot during operation of the cleaner, the gas being ignited by sparks from the motor's commutator. Thus, in most cases, there is a risk that such rapid combustion may occur with the consequent risk of damage to the cleaner and of the operator being at least scared by the noise.

DISCLOSURE OF THE INVENTION

It is the object of the present invention to provide a high-pressure cleaner of the kind referred to initially, in which the danger of rapid combustion within the housing damaging the equipment and causing concern to the operator is substantially eliminated, and this object is achieved with a high-pressure cleaner additionally exhibiting the feature set forth in the characterizing clause of claim 1.

With this arrangement, any increase in pressure within the housing, whether it be caused only by the air within the housing having been heated or by rapid combustion of a combustible gas mixture, will be released before building up to such magnitudes, that disadvantages of the kind referred to above may arise.

Advantageous embodiments of the high-pressure cleaner according to the present invention, the effects of which are explained in the following detailed portion of the present specification, are set forth in claims 2–8.

BRIEF DESCRIPTION OF THE DRAWINGS

In the following detailed portion of the present specification, the present invention will be explained in more detail with reference to the drawings, in which.

DESCRIPTION OF THE PREFERRED EMBODIMENT

Figure 1:
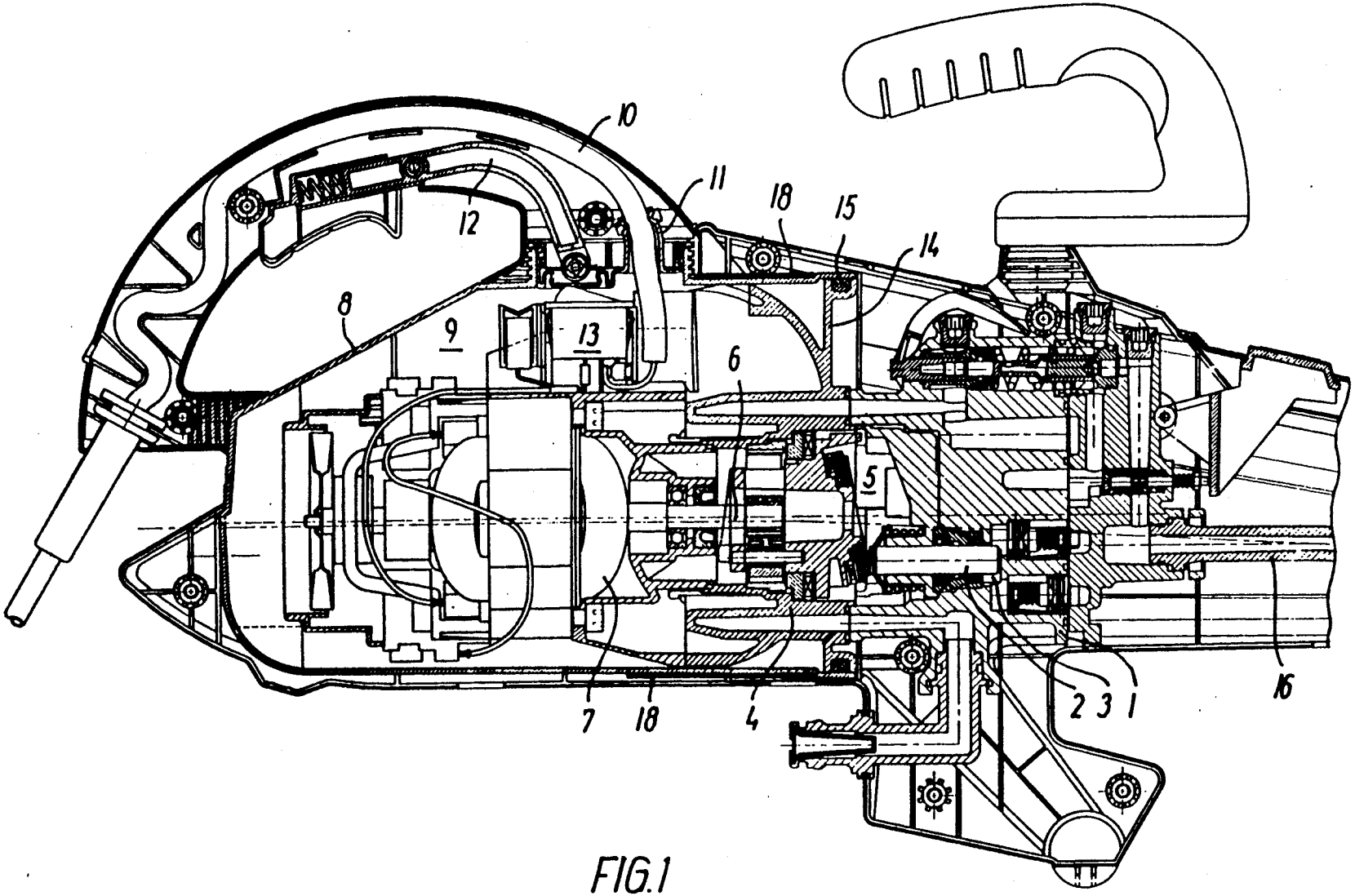
FIG. 1 is an axial vertical sectional view showing the parts of a high-pressure cleaner affected by the present invention.

The high-pressure cleaner shown on the drawing to the extent necessary for explaining the present invention comprises a pump housing 1 for a pump of the axial-piston type, of which only a single piston 2 and its cooperating cylinder 3 are shown.

The pump housing 1 is attached by means not shown to a drive-mechanism housing 4 containing a swash-plate drive mechanism 5 adapted to move the pistons 2 in a well-known manner. The swash-plate drive mechanism 5 is connected to the drive shaft 6 of an electric drive motor 7 mounted on the side or end of the drive-mechanism housing 4 facing away from the pump housing 1.

Both the drive-mechanism housing 4 and the electric drive motor 7 are enclosed within a common housing 8, the inside space 9 of which is isolated in a watertight manner from the surrounding atmosphere. Thus, the mains cable 10 for the motor 7 is enclosed by a flexible diaphragm 11, this diaphragm also serving to transmit the movements of a trigger arm 12 through a switch 13 controlling the motor 7. Further, the end of the housing 8 facing towards the pump housing 1 is closed in a watertight manner by an end shield 14, integral with the drive-mechanism housing 4 and sealed against the housing 8 by means of a sealing ring 15, extending all the way around the end shield 14.

For the sake of good order, it should be mentioned that the pump comprising the pump housing 1, the pistons 2 and the cylinders 3 is adapted to deliver liquid under high pressure to a jet lance 16, of which only the proximal part is shown. The present invention does not relate to the manner, in which the supply of high-pressure liquid to the jet lance 16 is provided and controlled, for which reason no further explanation relating thereto will be given in the present specification.

Experience has shown that a combustible gas mixture may form within the inside space 9 of the housing 8. Considering the fact that in a practical embodiment of a high-pressure cleaner of the kind shown and described, the volume of the inside space 9 may be of the order of 1700 $cm^3$, it will be appreciated that such gas mixtures may contain a considerable amount of energy, released when the mixture is ignited, e.g. by some hot part of the motor 7 or sparks from the motor's commutator. If this energy is liberated suddenly, e.g. through rapid combustion, there is a risk that the housing 8 or the parts cooperating therewith, such as the flexible diaphragm 11, may be damaged. Further, the noise and/or vibrations from such rapid combustion may distract the user of the high-pressure cleaner from the task of controlling it properly, not least to avoid the high-pressure jet of liquid going astray.

In order to prevent unduly high pressures from building up in the inside space 9 of the housing 8, the wall of the latter is provided with a number of non-return valves allowing fluid flow from the space 9 to the surroundings, but not in the opposite direction. Such non-return valves are available on the market in a great variety according to the requirements of each particular application, and the desired effect could be achieved by mounting a suitable number of such valves in the wall of the housing 8.

In order to make these non-return valves as simple, effective, reliable and economical as possible, the high-pressure cleaner according to the present invention comprises these valves in the form of a number of holes 17 formed in the wall of the housing 8 and covered by a rubber strap 18 lying taut about the housing 8. As the latter has an outwardly facing curvature in the region containing the holes 17, the rubber strap 18 will exert a closing force on these holes, and will only open when subjected to a certain pressure difference between the inside space 9 and the surrounding atmosphere.

Figure 2:
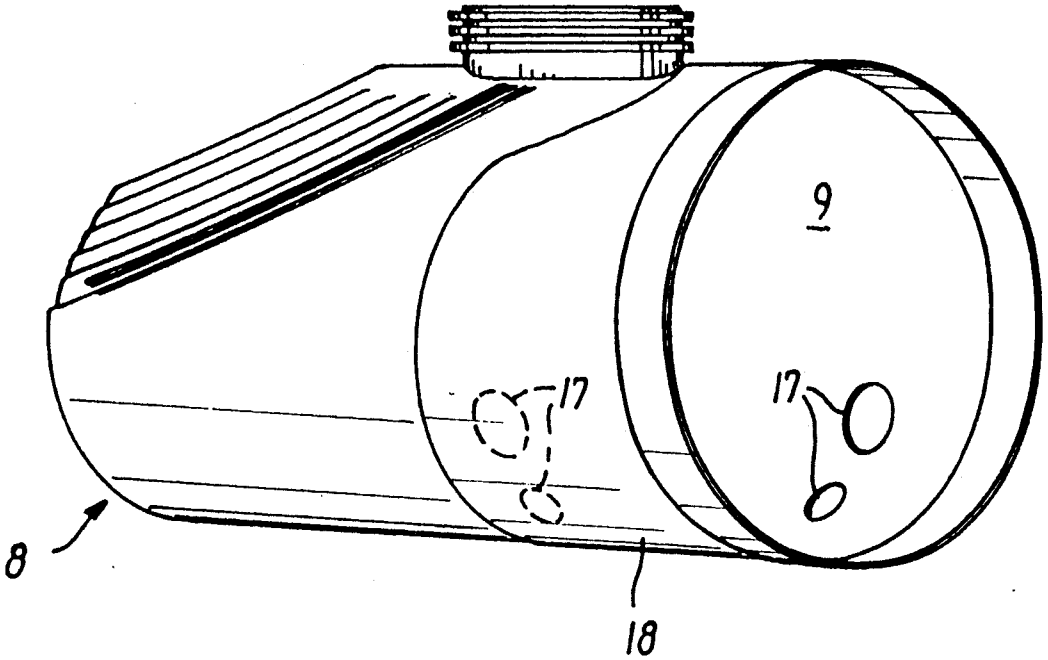
FIG. 2 is a perspective view of a part of the housing enclosing the electric drive motor and part of the pump arrangement shown in FIG. 1.

As may be seen from FIG. 2, the holes 17 are placed at some distance from the free edge of the housing 8, normally closed by the end shield 14 (not shown in FIG. 2) and at some distance below the widest part of the housing. Placing the holes 17 in this location has proved to give the most effective release of combustion energy, as the combustion will normally be initiated by some part of the motor 7 as indicated above.

Provided that the housing 8 has a smooth outside surface, at least in the region of the holes 17, and the inside of the rubber strap 18 is smooth, a good seal will be achieved around the holes 17 when the pressure conditions are normal.

In the practical embodiment mentioned above, in which the volume of the inside space 9 not occupied by solid parts is 1700 $cm^3$, four holes 17 with a total effective flow cross-sectional area of approximately 8 $cm^2$ have proved sufficient for releasing combustion energy to an extent sufficient to protect parts that could otherwise be damaged from the effect of a rapid combustion. In more general terms, this will mean that the total effective flow cross-sectional area of non-return valves to be used in carrying out the present invention should be at least 0.4 $cm^2$ for each 100 $cm^3$ of unoccupied inside space 9.

Experience has also shown that the requisite protection is achieved when the non-return valves are adapted to open at a pressure difference of approximately 0.2–0.4 bar. Obviously, for the housing 8 to remain effectively watertight, the non-return valves should close before this pressure difference is reduced to zero. In this connection it may be noted that most authorities demand that for the housing to be considered watertight, it should withstand at least 0.1 bar in the opposite direction without developing leaks.

I claim:

1. High-pressure cleaner comprising a) a high pressure pump for delivering cleaning liquid under high pressure to a cleaning-jet lance, b) an electric motor mechanically connected to the pump in a manner to drive the pump, and c) a substantially water-tight housing enclosing at least the motor, said cleaner further comprising d) at least one non-return valve communicating the inside of the housing with the outside of the housing in a manner allowing fluid only to pass from the inside of the housing to the outside.

2. Cleaner according to claim 1, wherein said non-return valve comprises a) a valve seat member connected to said housing, and b) a valve member adapted to cooperate with the side of said valve seat member facing towards the outside of said housing, c) at least a part of one of said members being adapted to cooperate sealingly the other of said members, said part being comprised of rubber or a rubber-like material that is sufficiently soft to ensure that the non-return valve is leak-free in the closed state.

3. Cleaner according to claim 1 and comprising an elastic member to hold the valve member in closing abutment against the valve seat, said elastic member being comprised of a rubber or a rubber-like material.

4. Cleaner according to claim 3, wherein a) the valve seat member of said at least one non-return valve includes an opening in a section of the wall of said housing having an outwardly convex curvature, and b) said elastic member comprises a strap or band of rubber or rubber-like material holding the valve member in abutment with the edge of the opening with which the valve member cooperates.

5. Cleaner according to claim 4, wherein the at least one valve member is constituted by a part of said strap or band situated immediately outside of an around the opening with which the valve member cooperates.

6. Cleaner according to claim 1, wherein the at least one valve is located adjacent the end of the motor facing towards the pump.

7. Cleaner according to claim 1, wherein the at least one valve is adapted to open when subjected to a pressure difference of approximately 0.2 to 0.4 bar and to close before the pressure difference is reduced to zero.

8. Cleaner according to claim 1, wherein the total effective flow cross-sectional area of the at least one valve when in the fully open condition is at least 0.4 $cm^2$ for each 100 $cm^3$ of unoccupied volume inside said housing.

* * * * *